US010118732B2

(12) United States Patent
Segerstrom

(10) Patent No.: US 10,118,732 B2
(45) Date of Patent: Nov. 6, 2018

(54) MAINTAINABLE PALLET

(71) Applicant: Lane Segerstrom, Frisco, TX (US)

(72) Inventor: Lane Segerstrom, Frisco, TX (US)

( * ) Notice: Subject to any disclaimer, the term of this patent is extended or adjusted under 35 U.S.C. 154(b) by 0 days.

(21) Appl. No.: 15/374,940

(22) Filed: Dec. 9, 2016

(65) Prior Publication Data

US 2018/0162588 A1 Jun. 14, 2018

(51) Int. Cl.
*B65D 19/38* (2006.01)
*B65D 19/00* (2006.01)

(52) U.S. Cl.
CPC ..... *B65D 19/38* (2013.01); *B65D 19/0093* (2013.01); *B65D 2519/00039* (2013.01); *B65D 2519/00074* (2013.01); *B65D 2519/0099* (2013.01); *B65D 2519/00109* (2013.01); *B65D 2519/00114* (2013.01); *B65D 2519/00179* (2013.01); *B65D 2519/00184* (2013.01); *B65D 2519/00273* (2013.01); *B65D 2519/00293* (2013.01); *B65D 2519/00323* (2013.01); *B65D 2519/00338* (2013.01); *B65D 2519/00572* (2013.01); *B65D 2519/00796* (2013.01)

(58) Field of Classification Search
CPC ..... B65D 19/00; B65D 2519/00547; B65D 2519/00552; B65D 2519/00034
USPC ..... 108/51.11, 51.3, 56.1, 57.25
See application file for complete search history.

(56) References Cited

U.S. PATENT DOCUMENTS 2,371,106 A * 3/1945 Lewis et al. ..... B65D 19/0069 108/57.1
2,922,606 A 1/1960 Glassman et al.
3,677,200 A 7/1972 Coccagna et al.
3,878,796 A * 4/1975 Morrison ..... B65D 19/0075 108/56.1

(Continued)

FOREIGN PATENT DOCUMENTS

CN 201381001 Y 1/2010
EP 1195600 A2 4/2002

OTHER PUBLICATIONS

International Search Report and Written Opinion for PCT Application No. PCT/US16/66010 dated Mar. 3, 2017.

*Primary Examiner* — Jose V Chen
(74) *Attorney, Agent, or Firm* — Foley & Lardner LLP

(57) ABSTRACT

In one embodiment, a maintainable pallet is provided with interchangeable support structures and sensors for identifying any damage that the interchangeable support structures may experience. The maintainable pallet may include two side supports, two end supports coupled to the two side supports end-to-end to form a rectangle, a central support position between the two side supports, a plurality of top transverse support fastened onto the two side supports to form a top loading surface and the central support with two-part releasable fasteners, and two bottom transverse supports fastened to the ends of the two side supports to form a bottom surface with two-part releasable fasteners. Sensors, in some embodiments, may be embedded in the two side supports to measure, for example, acceleration, loca- (Continued)

tion, or other logistic information. When a damaged piece is identified, the maintainable pallet can be disassembled by unfastening the two-part releasable fasteners to remove the damaged piece; and a new interchangeable piece will replace the damaged piece.

17 Claims, 6 Drawing Sheets

(56) References Cited

U.S. PATENT DOCUMENTS 4,128,253 A * 12/1978 Powers ..... B65D 19/0012 108/55.1
D267,386 S 12/1982 Kneale, Ill
D306,226 S 2/1990 Jirucha
5,007,352 A * 4/1991 Calkoen ..... B65D 19/0059 108/56.1
5,042,397 A 8/1991 Fiedler
5,197,396 A * 3/1993 Breezer ..... B65D 19/0012 108/56.1
5,337,681 A * 8/1994 Schrage ..... B65D 19/0071 108/56.1
5,413,662 A * 5/1995 Skinner, III ..... B03B 9/061 108/51.3
5,579,701 A * 12/1996 Fook Wah ..... B65D 19/0069 108/56.1
5,662,048 A * 9/1997 Kralj ..... B65D 19/0012 108/56.1
5,673,629 A * 10/1997 Ginnow ..... B65D 19/0095 108/56.1
5,834,105 A 11/1998 White et al.
5,967,056 A * 10/1999 Plante ..... B65D 19/0038 108/56.1
6,192,807 B1 2/2001 Mason
6,216,608 B1 * 4/2001 Woods ..... B65D 19/0012 108/56.1
6,357,366 B1 3/2002 Frankenberg
6,408,768 B1 * 6/2002 Giampavolo ..... B65D 19/38 108/27
7,004,083 B2 * 2/2006 Ramirez von Holle ..... B65D 19/0026 108/57.25
7,557,714 B2 7/2009 Roeder et al.
7,735,430 B2 * 6/2010 Muirhead ..... B65D 19/0012 108/57.25
7,802,527 B2 * 9/2010 Dong ..... B65D 19/001 108/54.1
D679,065 S 3/2013 Hershey et al.
8,627,773 B2 * 1/2014 Storteboom ..... B65D 19/38 108/51.11
9,193,499 B2 * 11/2015 Jordan ..... B65D 19/0012
D780,470 S 3/2017 Segerstrom
D789,648 S * 6/2017 Segerstrom ..... D34/38
2006/0169185 A1 * 8/2006 Williams, Jr. ..... B65D 19/0095 108/56.3
2006/0254474 A1 * 11/2006 Roth ..... B65D 19/0095 108/51.11
2007/0062419 A1 * 3/2007 Stevens ..... B29C 41/04 108/51.11
2008/0103944 A1 * 5/2008 Hagemann ..... B65D 19/004 705/28
2011/0303128 A1 12/2011 Linares
2012/0298015 A1 * 11/2012 Jian ..... B65D 19/0097 108/56.1
2014/0174327 A1 6/2014 Whiteford
2014/0251188 A1 9/2014 Jordan
2014/0251189 A1 9/2014 Takyar
2014/0251190 A1 9/2014 Kessler
2015/0274358 A1 10/2015 Hidalgo
2015/0298854 A1 * 10/2015 Linares ..... B65D 19/0018 108/11
2015/0321792 A1 11/2015 Joung
2015/0360809 A1 12/2015 McBride et al.

* cited by examiner

MAINTAINABLE PALLET

FIELD

This disclosure relates to a transport structure, such as a platform for supporting items, to be lifted and moved using various types of transportation vehicles including forklifts.

BACKGROUND

A pallet is a flat transport structure used to support goods in a stable manner. It provides a platform for items to be loaded securely onto and enables forklifts or other utility vehicles to insert arms underneath the platform for lifting and manipulation. For example, a pallet has a top supporting surface higher than the ground to allow transportation equipment to reach under the top supporting surface. Transportation equipment can include a forklift, pallet jack, front loader, work saver or other jacking devices, or a crane. Goods may be secured to the pallet by strapping, with stretch wrap, or with shrink wrap. Pallets can be made of wood, plastic, metal, paper, or materials that are strong enough to support the cargo while light enough to avoid adding substantial weight for transportation. Because pallets are handled with various transportation vehicles during shipping, collision, tear, shear, or overloading often cause structural damage to the pallets, in addition to the other significant mechanical stresses sustained by such pallets in supporting heavy loads.

SUMMARY

This disclosure describes a maintainable pallet that includes at least two side supports, a central support positioned between the at least two side supports, a plurality of top transverse supports positioned above the at least two side supports and the central support to form a top loading surface and fastened at least partially with two-part releasable fasteners; and two bottom transverse supports positioned adjacent and fastened at least partially to bottom ends of the at least two side supports to form a bottom surface, and fastened at least partially with two-part releasable fasteners.

In some embodiments, the at least two bottom transverse supports are fastened to the central support with two-part releasable fasteners.

In some other embodiments, the at least two side supports forms an "M" shape in a side view, wherein the "M" shape is scaled to receive forks of forklifts.

In yet some other embodiments, each of the "M" shape of the at least two side supports further comprises a center leg, wherein at least one center transverse support is fastened to each of the center leg of the at least two side supports with two-part releasable fasteners. The central support has an "M"' shaped side cross section and a center leg as the two side supports; and the at least one center transverse support is fastened to the center leg of the central support with one or more two-part releasable fasteners.

In some embodiments, the at least two end supports each couples the at least two side supports end-to-end, using one of a comb joint, finger joint, or box joint.

In some other embodiments, the at least two side supports, the central support, the plurality of top transverse supports, and the at least two bottom transverse supports all comprise composites made from biomass material embedded in a polymer matrix. The composites have an aligned direction same as an length direction of the at least two side supports, the central support, the plurality of top transverse supports, and the at least two bottom transverse supports.

In yet some other embodiments, the two-part releasable fasteners include nuts and bolts having tee nut inserts, and plain wood screws, but excluding nails.

In some embodiments, the at least two side supports, the central support, the plurality of top transverse supports, and the at least two bottom transverse supports are configured to receive forks of a forklift from one end of the at least two side supports.

In some other embodiments, the maintainable pallet comprises one or more sensors embedded in one or more of the at least two side supports. The sensors include at least one of an accelerometer, a global positioning system (GPS) receiver, an inertial sensor, and an radio frequency identifier (RFID). The sensors may record data indicating structural integrity of the maintainable pallet and upon determining that an acceleration or stress signal has exceeded a predefined value, at least one of the at least two side supports, the central support, the plurality of top transverse supports, and the at least two bottom transverse supports is replaced with a same interchangeable part.

In yet some other embodiments, the at least two side supports and the central support are shaped to receive the plurality of top transverse supports in full half lap joints, cross halving joints, or T half lap joints, such that the at least two side supports and the central support are flush with the plurality of top transverse supports to form the top loading surface.

In some embodiments, each of the at least two side supports comprises three layers of composite boards; the central support comprises at least two layers of composite boards, and each of the plurality of top supports comprises one layer of composite boards. A center layer of the three layers of composite boards of the at least two side supports is embedded with one or more from the group that includes an accelerometer, location sensor, a strain sensor, and a transmitter. The at least two side supports, the at least two bottom transverse supports, and the at least two end supports further comprise chamfered edges for reducing resistance during insertion of forks of a forklift.

A method for maintaining a maintainable pallet includes detecting an acceleration or stress via a sensor embedded in the maintainable pallet, wherein the pallet comprises interchangeable parts fastened using two-part releasable fasteners. Based on the acceleration or stress detected, one or more damaged pieces in the maintainable pallet are identified. The two-part releasable fasteners on the identified damaged pieces are released to remove the damaged pieces. Then one or more corresponding new pieces are used to replace the damaged pieces.

In some embodiments, the sensor comprises at least one from the group that includes an accelerometer, a GPS, an inertial sensor, and an RFID.

In some other embodiments, the maintainable pallet further includes two side supports, two end supports coupled to the two side supports end-to-end to form a rectangle, a central support position between the two side supports, a plurality of top transverse support fastened onto the two side supports to form a top loading surface and the central support with two-part releasable fasteners, and two bottom transverse supports fastened to the ends of the two side supports to form a bottom surface with two-part releasable fasteners.

At a high level, this disclosure describes a maintainable pallet assembled from interchangeable parts using multiple two-part releasable fasteners, wherein some of the interchangeable parts may be embedded with sensors to track the usage and identify damages. If one or more of the interchangeable parts are damaged, the damaged pieces can be replaced, thus minimizing material waste. For example, the sensors may be used to identify the pallet and its shipment content, to track its location, to measure forces experienced by the pallet for fragile shipments, or to measure the integrity of the pallet. Further, in other embodiments, the interchangeable pieces are made from biomass materials grown in a short life cycle, such that the cost and any negative impact to the environment is very low.

BRIEF DESCRIPTION OF FIGURES

Like elements are labeled using like numerals.

DETAILED DESCRIPTION

Figure 1:
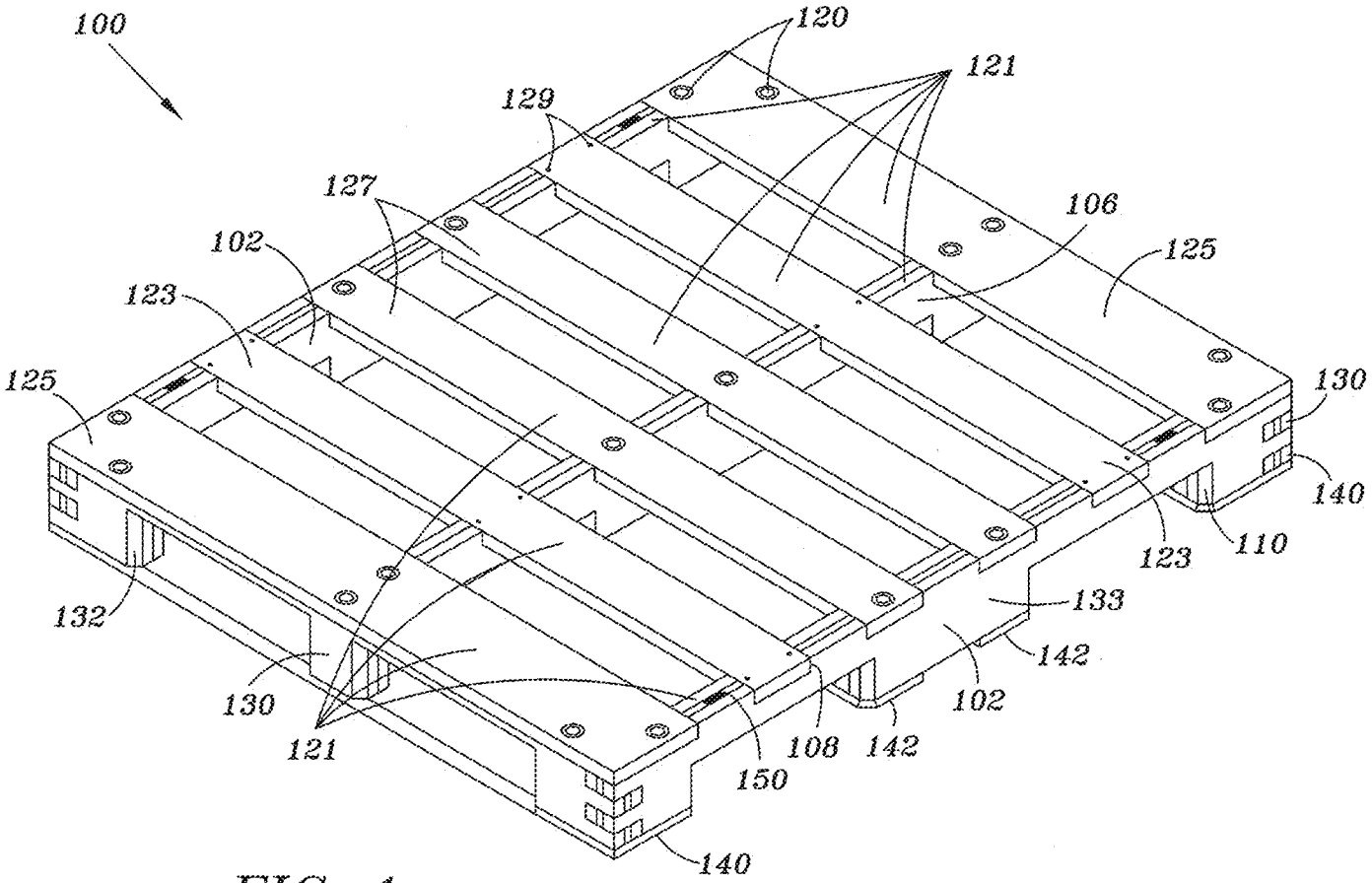
FIG. 1 is a perspective view of a maintainable pallet.

FIG. 1 is a perspective view of a maintainable pallet 100 according to one embodiment. The maintainable pallet 100 includes two side supports 102, two front end supports 130, a central support 106 positioned between the two side supports 102, a plurality of top transverse supports 123, 125, and 127 fastened on or adjacent the two side supports 102 and the central support 105 to form a top loading surface 121 with two-part releasable fasteners 120. For example, the two side supports 102 and the central support 106 are shaped to receive the top transverse supports 123, 125, and 127 in full half lap joints, cross halving joints, or T half lap joints, such that the two side supports 102 and the central support 106 are flush with the top transverse supports 123, 125 and 127 to form the top loading surface 121. There are two bottom transverse supports 140 fastened to the bottom ends of the two side supports 102 to form a bottom surface with two-part releasable fasteners 120. The two bottom transverse supports 140 may be further fastened to the central support 106 with two-part releasable fasteners 120.

Figure 5:
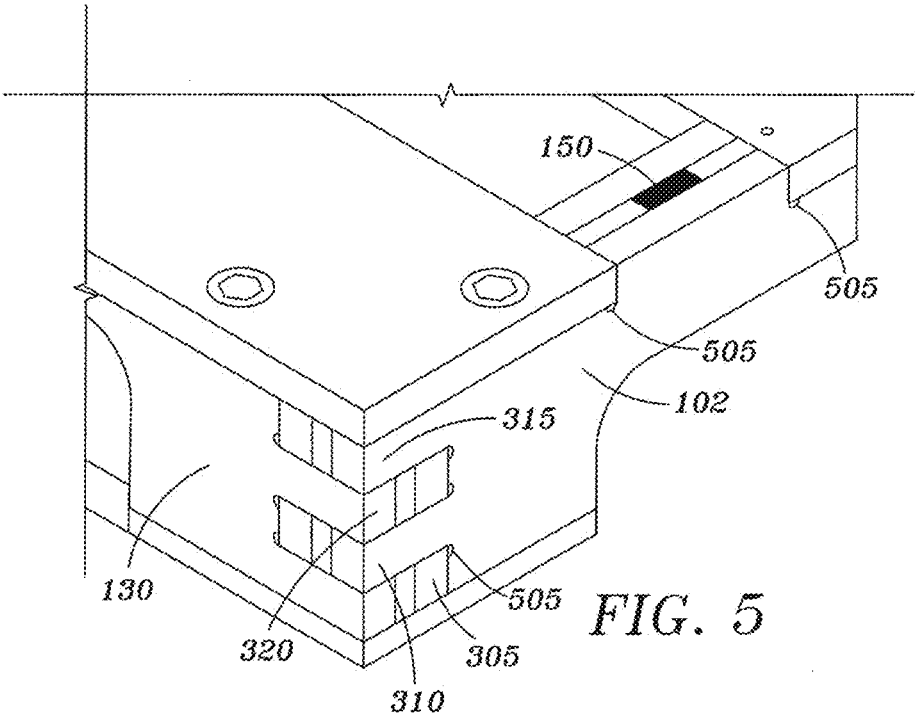
FIG. 5 is a local perspective view of the maintainable pallet showing details of sensor location and the coupling of interchangeable parts of the maintainable pallet.

The two side supports 102 and the two end supports 130 are coupled with each other end-to-end to form a rectangle, according to one implementation. In the example illustrated in FIG. 1, with further details shown in FIG. 5, the end-to-end coupling may be achieved using a plurality of box joints 305, 310, 315, and 320. As shown in FIG. 5, in some instances, the box joints 305, 310, 315, and 320 may further include spaces 505 for improving the assembly process. In some embodiments, the box joints 305, 310, 315 and 320 may be replaced with other wood joints such as comb joints, finger joints, or other proper corner joints (e.g., dovetail joint, butt rub joint, biscuit joint, mitred biscuit joint, etc.). In some embodiments, for cost saving or other production reasons, the two side supports 102 and the two end supports 130 may be joined directly with fasteners at abutting positions.

Returning to FIG. 1, the maintainable pallet 100 further includes sensors 150 embedded in the two side supports 102. The sensors 105 include at least one of an accelerometer, a Global Positioning System (GPS) sensor, an inertial sensor, and an active and/or passive radio frequency identification (RFID) tag. The sensors 150 record data, in one embodiment, indicating structural integrity of the maintainable pallet and upon determining that an acceleration or stress signal has exceeded a predefined value, at least one of the two side supports 102, the two end supports 130, the central support 106, the plurality of top transverse supports 123, 125, and 127, and the two bottom transverse supports 140 is replaced with a same or similar interchangeable part.

In some embodiments, an accelerometer or an inertial sensor enables the maintainable pallet 100 to report to a central data gathering system or communication station about the forces experienced during a particular shipment. The force history data can be used to assess any risks associated with shipping fragile items. In another embodiment, a GPS sensor 150 enables end users or the carrier to track a shipment carried on the maintainable pallet 100. In yet another embodiment, an identification sensor (e.g., an RFID) may enable carriers or users to identify a bundle of shipment loaded on a particular pallet or for other logistic uses.

In some embodiments, the two side supports 102, the central support 106, the plurality of top transverse supports 123, 125, and 127, and the two bottom transverse supports 140 comprise composites made from biomass material embedded in a polymer matrix. For example, the composites may be corn-based structural composites that include a fibrous component of corn. In some embodiments, the composites include a structural polymeric composite having a polymer matrix and intact corn husks. The corn husks may be laminated using a polymer matrix of epoxy resin, phenol-formaldehyde, or a polyester, or using any other suitable binder.

The corn husks may have elongate fibers aligned with a first line along the length of each husk, and the corn husks are disposed in a corn husk layer such that the first lines of the corn husks are aligned in the corn husk layer. In some other embodiments, the corn husks may further have elongate fibers aligned with a first line along the length of each husk, and the corn husks are disposed in a corn husk layer such that the first lines of the corn husks are randomly oriented in the corn husk layer. The composites may have an aligned direction same as an length direction of the two side supports 102, the central support 106, the plurality of top transverse supports 123, 125, and 127, and the two bottom transverse supports 140.

In the present embodiment, the two side supports 102 and the central support 106 are shaped to receive the plurality of top transverse supports 123, 125, and 127 such that the two side supports 102 and the central support 106 are exposed to form the top loading surface 121.

Figure 2:
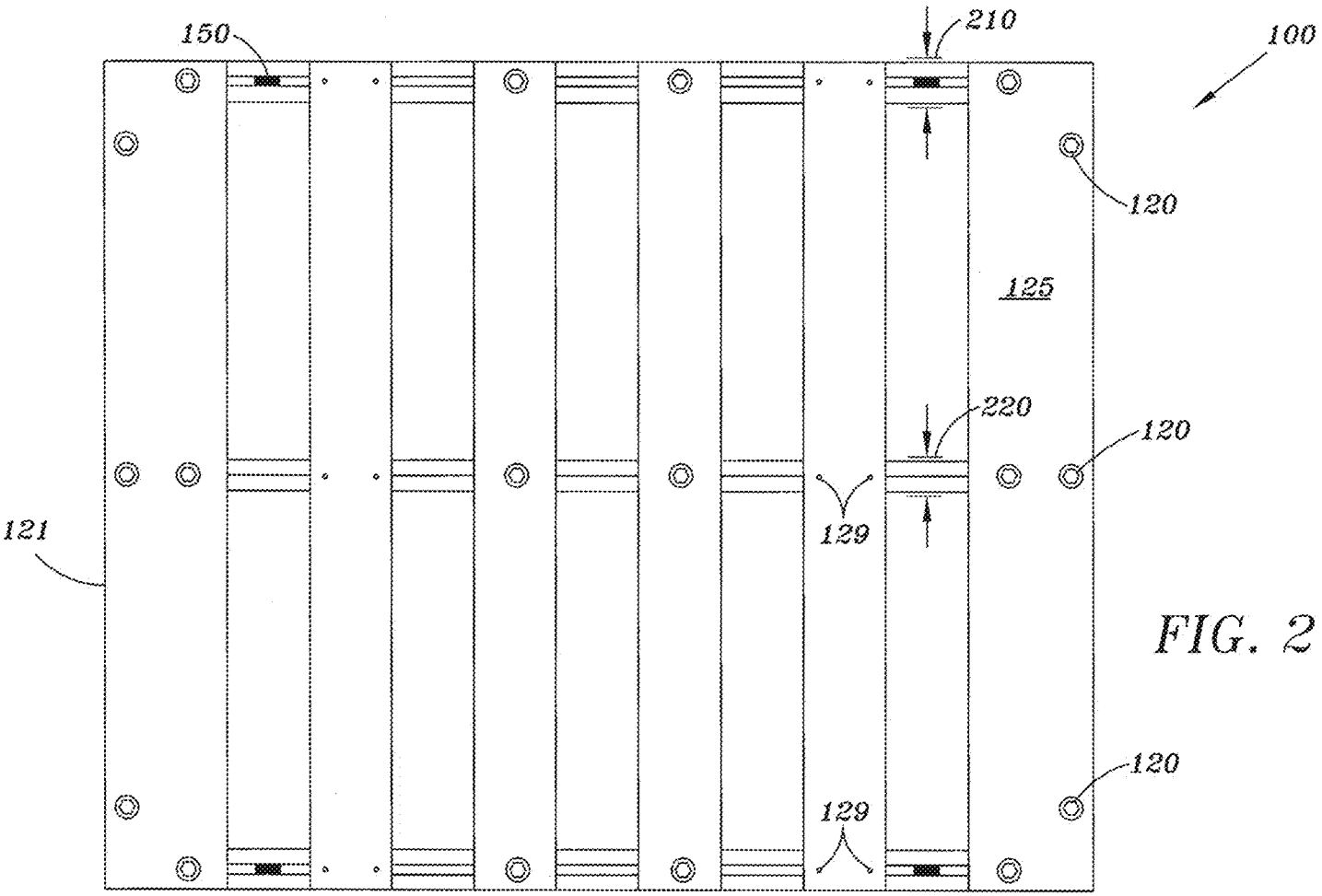
FIG. 2 is a top view of the maintainable pallet.
Figure 9:
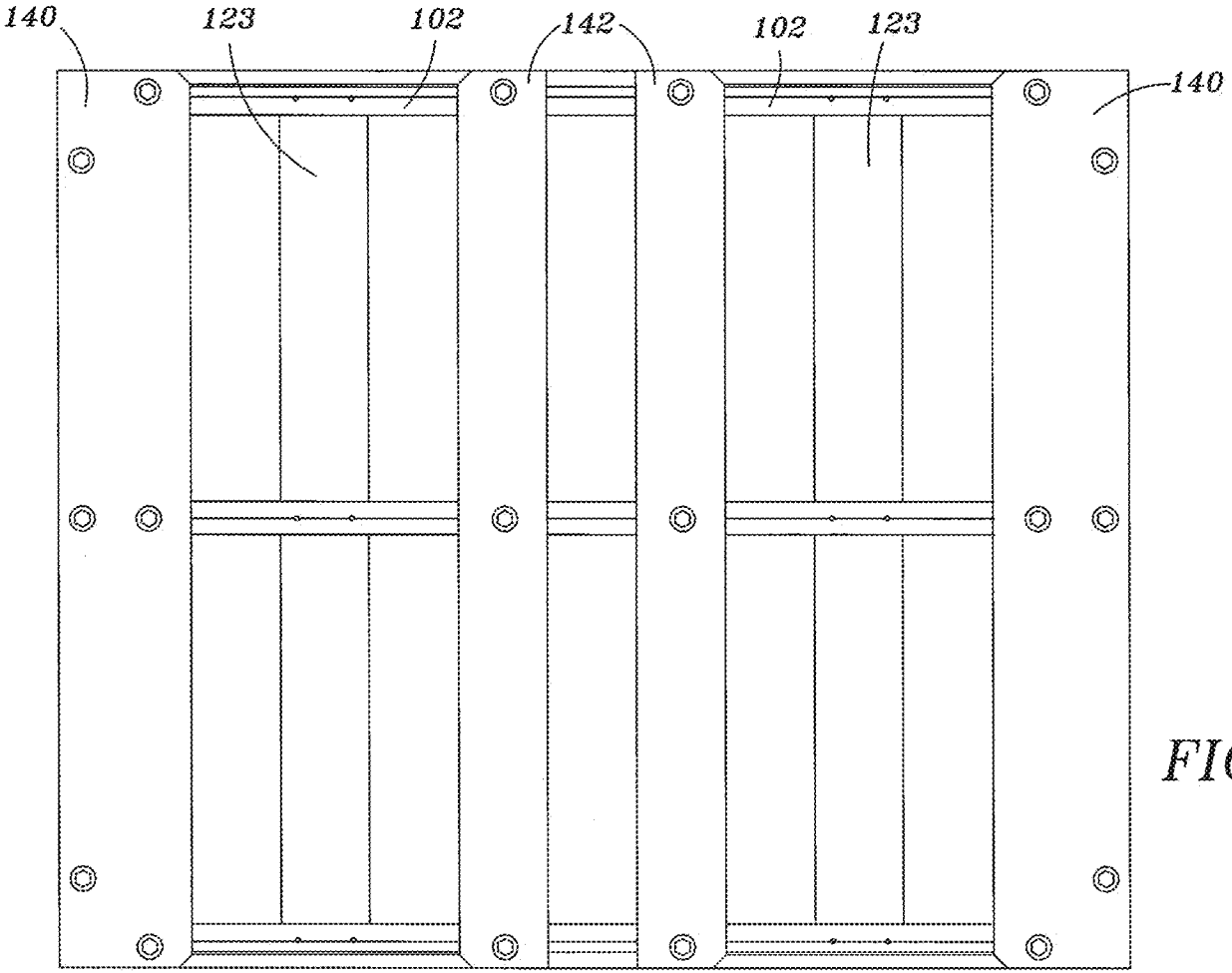
FIG. 9 is a bottom view of the maintainable pallet.

Referring now to FIG. 2 and FIG. 9, respectively a top and a bottom view of the maintainable pallet 100. Each of the two side supports 102 comprises three layers of composite boards in this embodiment. The central support 106 comprises two layers of composite boards, in this embodiment. Each of the plurality of top supports 123, 125, and 127 comprises one layer of composite boards. In some embodiments, a center layer of the three layers of composite boards of the two side supports 102 is embedded with the sensor 150, or otherwise, an accelerometer, location sensor, a strain sensor, a transmitter, or a transceiver.

Figure 3:
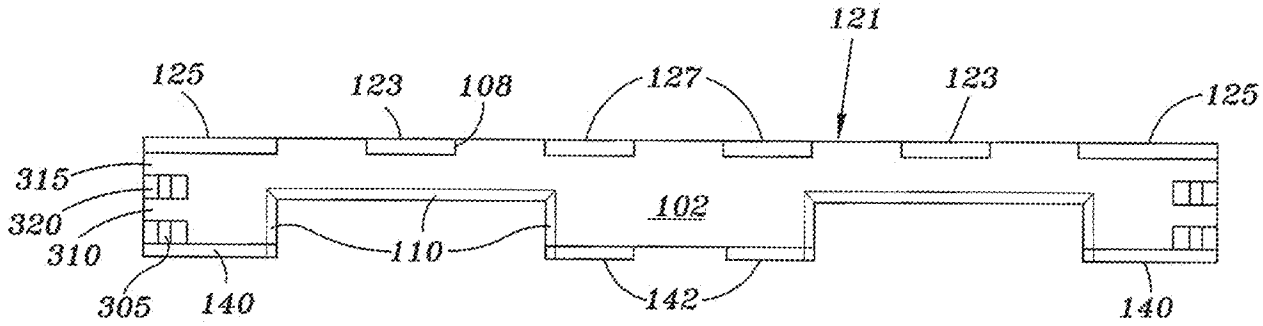
FIG. 3 is a right side view of the maintainable pallet, with the left side being a mirror image thereof.

FIG. 3 is a side view of the maintainable pallet 100 according to one embodiment. In the side view, it has shown that the two side supports 102 forms an "M" shape, wherein the "M" shape may be scaled to receive forks of forklifts or other lifting or transportation equipment, such as pallet jack, front loader, work saver, or other jacking device. Each of the "M" shape of the two side supports 102 further comprises a center leg 133, wherein at least one center transverse support 142 is fastened to each of the center legs 133 of the two side supports 102 with two-part releasable fasteners. The central support 106 may have the same "M" shaped side cross section and a center leg 133 as the two side supports 102. The at least one center transverse support 142 is also fastened to the center leg of the central support with two-part releasable fasteners. The two side supports 102, the two end supports 130, the central support 106, the plurality of top transverse supports 123, 125, 127, and the two bottom transverse supports are configured to receive forks of a forklift from one end of the two side supports.

Figure 4:
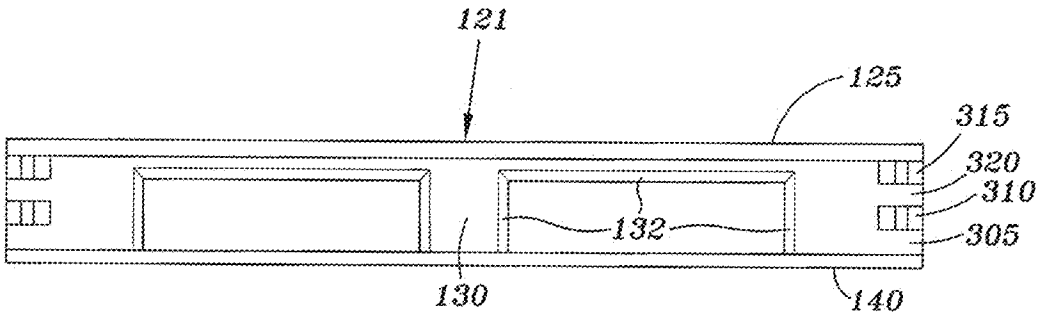
FIG. 4 is a front view of the maintainable pallet, with the rear view being a mirror image thereof.

FIG. 4 is a front view of the maintainable pallet 100. As illustrated in FIGS. 3 and 4, the two side supports 102, the two bottom transverse supports 140, and the two end supports 130 further comprise chamfered edges 110 and 132, in certain embodiments, for reducing resistance during insertion of forks of a forklift. The two end supports 130 may have a similar "M" shaped profile as the two side supports 102 for receiving forks of a forklift or other cargo handling and transportation equipment.

FIG. 5 is a local perspective view of the maintainable pallet showing details of sensor location, in one embodiment, and the coupling of interchangeable parts of the maintainable pallet. In the present example, the two-part releasable fasteners 120 include nuts and bolts having tee nut inserts. But in other examples plain wood screws may also be used.

Figure 6:
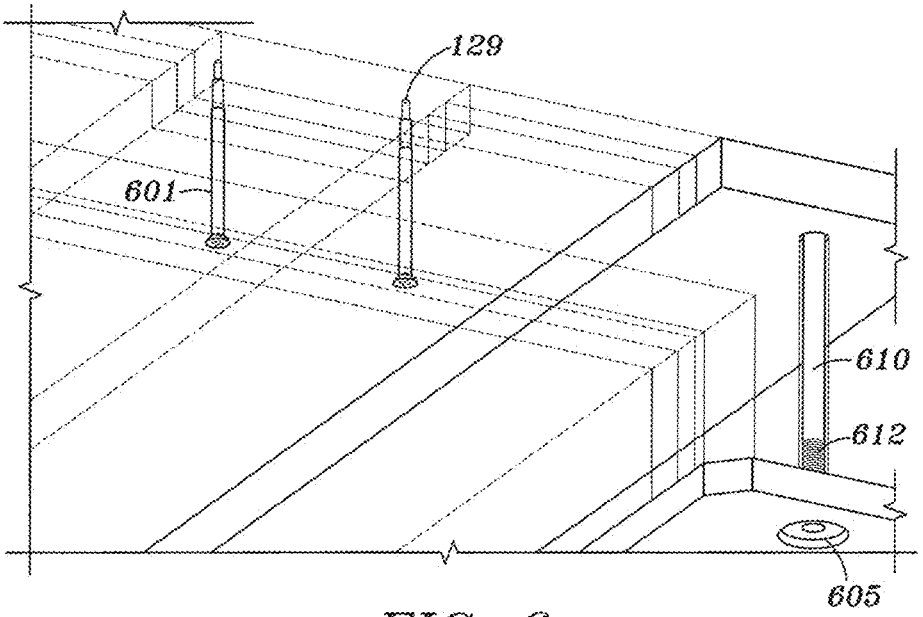
FIG. 6 is a perspective bottom view showing examples of two-part releasable fasteners.

FIG. 6 is a perspective bottom view showing examples of two-part releasable fasteners 120. Two-part releasable fastener 120 may include a bolt 610 and a nut 605 coupled via threads 612. The two-part releasable fastener 120 may also be a plain screw 601 or similar wood screws used to fasten the plurality of top transverse pieces 123, 125, and 127. Other types of releasable or reusable fasteners 120 may be used in substitute for the illustrated screws.

Figure 7:
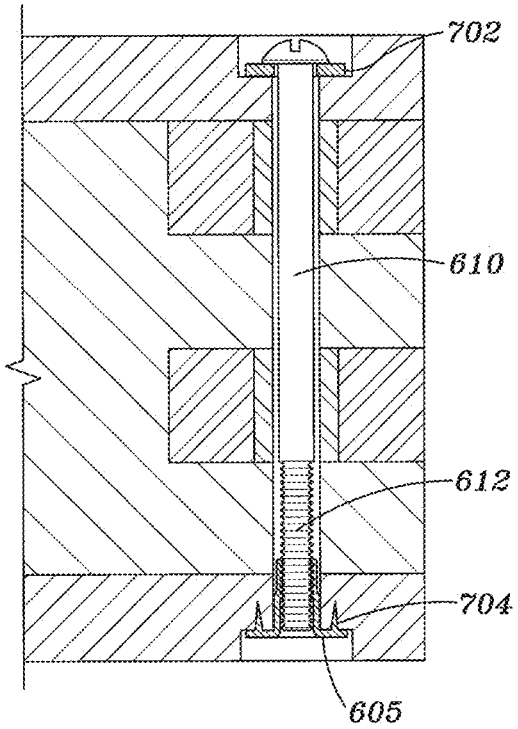
FIG. 7 is a local cross section view of the maintainable pallet showing an example two-part releasable fastener.

FIG. 7 is a local cross section view of the maintainable pallet showing an example two-part releasable fastener 120. The local cross section view shows that the nut 605 may further include teeth 704 that prevents the nut 605 from rotation during fastening. A washer 702 may also be included to distribute loads evenly and to allow for a higher tension applied to the bolt 610. In some embodiments, the nut has tee nut inserts such that the teeth 704 and the washer 702 and the nut 605 are all integrated as one piece.

Figure 8:
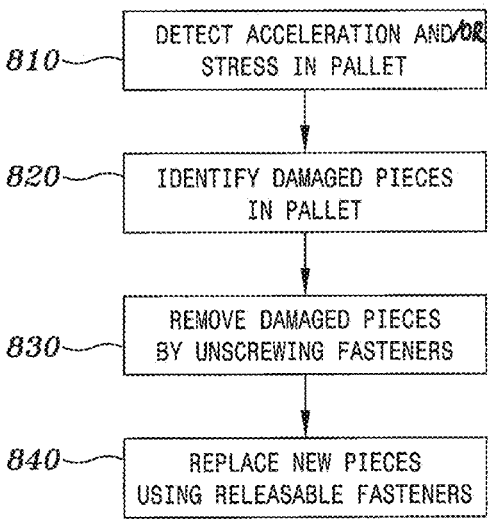
FIG. 8 is a flowchart illustrating a method for maintaining the maintainable pallet.

FIG. 8 is a flowchart illustrating a method 800 for maintaining the maintainable pallet. At 810, an acceleration or stress is detected via a sensor 150 embedded in the maintainable pallet 100. At 820, one or more damaged pieces in the maintainable pallet 100 is identified using the measurements taken with the sensor 150. In other embodiments, visual inspection may also identify the interchangeable pieces that require replacement. At 830, the two-part releasable fasteners of the pallet 100 are unscrewed to remove the identified one or more damaged pieces. At 840, the removed one or more damaged pieces are replaced with corresponding new pieces.

The disclosure above provides enumerated examples. Other implementation and embodiments are possible within scopes of the following claims.

What is claimed is:

1. A maintainable pallet comprising:

at least two side supports;

a central support positioned between the at least two side supports;

a plurality of top transverse supports positioned above the at least two side supports and the central support to form a top loading surface and fastened at least partially with releasable fasteners, wherein the central support includes a plurality of recesses for receiving two or more of the plurality of top transverse supports, and wherein the central support includes at least one member positioned adjacent a second member to provide central mechanical support, and the at least one member and the adjacent second member of the central support jointly provide an opening that receives one or more of the releasable fasteners to fasten one or more of the top transverse supports to the central support; and two bottom transverse supports positioned adjacent bottom ends of the at least two side supports to form a bottom surface, and fastened at least partially with releasable fasteners.

2. The maintainable pallet of claim 1, wherein the at least two bottom transverse supports are fastened to the central support with releasable fasteners.

3. The maintainable pallet of claim 1, wherein the at least two side supports form an "M" shape in a side view, wherein the "M" shape is scaled to receive forks of forklifts.

4. The maintainable pallet of claim 3, wherein the "M" shape of the at least two side supports further comprises a center leg, wherein at least one center transverse support is fastened to each of the center leg of the at least two side supports with releasable fasteners.

5. The maintainable pallet of claim 4, wherein the central support has an "M" shaped side cross section and a center leg, and the at least one center transverse support is fastened to the center leg of the central support with one or more releasable fasteners.

6. The maintainable pallet of claim 1, further comprising at least two end supports configured to couple at least one end of the at least two side supports.

7. The maintainable pallet of claim 6, wherein the at least two side supports, the at least two bottom transverse supports, and the at least two end supports further comprise chamfered edges for reducing resistance during insertion of forks of a forklift.

8. The maintainable pallet of claim 1, wherein the at least two side supports, the central support, the plurality of top transverse supports, and the at least two bottom transverse supports all comprise composites made from biomass material embedded in a polymer matrix.

9. The maintainable pallet of claim 8, wherein the composites have an aligned direction same as a length direction of the at least two side supports.

10. The maintainable pallet of claim 1, wherein the releasable fasteners include one or more from the group consisting of nuts and bolts having tee nut inserts, and plain wood screws, but excluding nails.

11. The maintainable pallet of claim 1, wherein the at least two side supports, the central support, the plurality of top transverse supports, and the at least two bottom transverse supports are configured to receive forks of a forklift from one end of the at least two side supports.

12. The maintainable pallet of claim 1, further comprises one or more sensors embedded in one or more of the at least two side supports.

13. The maintainable pallet of claim 12, wherein the sensors include at least one of an accelerometer, a GPS, an inertial sensor, and an RFID.

14. The maintainable pallet of claim 13, wherein the sensors record data indicating structural integrity of the maintainable pallet and upon determining that an acceleration or stress signal has exceeded a predefined value, at least one of the at least two side supports, the central support, the plurality of top transverse supports, and the at least two bottom transverse supports is replaced with a same interchangeable part.

15. The maintainable pallet of claim 1, wherein the at least two side supports and the central support are shaped to receive the plurality of top transverse supports such that at least a portion of the at least two side supports and the central support are exposed to form at least a portion of the top loading surface.

16. The maintainable pallet of claim 1, wherein each of the at least two side supports comprises at least three layers of composite boards, the central support comprises at least two layers of composite boards, and each of the plurality of top transverse supports comprises at least one layer of composite boards.

17. The maintainable pallet of claim 16, wherein a center layer of the three layers of composite boards of the at least two side supports is embedded with one or more from the group that includes an accelerometer, location sensor, a strain sensor, and a transmitter.

* * * * *